US006146196A

United States Patent [19]

Burger et al.

[11] Patent Number: 6,146,196

[45] Date of Patent: Nov. 14, 2000

[54] MATED COAXIAL CONTACT SYSTEM

[76] Inventors: Edward W. Burger, 9025 N. 14th Dr., Phoenix, Ariz. 85021; Eric J. Paulus, 4050 E. Weaver Rd., Phoenix, Ariz. 85050; Derald L. Ryan, 4927 W Morton, Phoenix, Ariz. 85301; Robert F. Stanton, P.O. Box 7734, Cave Creek, Ariz. 85327

[21] Appl. No.: 09/280,490

[22] Filed: Mar. 30, 1999

[51] Int. Cl.[7] ..... H01R 9/07

[52] U.S. Cl. ..... 439/578; 439/675

[58] Field of Search ..... 439/578, 598, 439/675, 579–585

[56] References Cited

U.S. PATENT DOCUMENTS 3,112,977 12/1963 Long et al. .
3,161,453 12/1964 Powell .
4,917,630 4/1990 Hubbard ..... 439/578
5,295,863 3/1994 Cady ..... 439/578
5,620,339 4/1997 Gray et al. ..... 439/578
5,667,409 9/1997 Wong et al. ..... 439/654
5,975,948 11/1999 Weaver ..... 439/578

*Primary Examiner*—Khiem Nguyen
*Assistant Examiner*—Son V. Nguyen
*Attorney, Agent, or Firm*—Edward E. Roberts

[57] ABSTRACT

A mated coaxial contact system including a nano-miniature pin and socket contact centered in a shielding sleeve by a dielectric insulator. The pin and socket contacts are each mechanically crimped to the respective center conductor of the coaxial wire. The conductive braid of the coaxial wire is soldered to the shielding sleeve with a disc insulator overlaying the terminal end of the insulation encircling the center conductor, thus facilitating solder of the braid to the sleeve and preventing electrical shorts between the center conductor and the braid of the coaxial wire.

12 Claims, 4 Drawing Sheets

MATED COAXIAL CONTACT SYSTEM

BACKGROUND OF THE INVENTION

The background of the invention will be discussed in two parts.

1. Field of the Invention

This invention relates to connectors, and more particularly, to a miniaturized coaxial connector system.

2. Description of the Prior Art

Coaxial cable connector arrangements exemplary of the prior art are shown and described in U.S. Pat. Nos. 3,112,977, issued to Long et al and 3,161,453, issued to Powell. Essentially, for a coaxial cable system, the purpose of the connector is to provide a mating coacting male and female connector, which do not materially affect the impedance of the system in use. Coaxial cable includes a center conductor surrounded by an insulation layer, which is surrounded by a flexible braid tube or sleeve. The connector, both male and female, include a central contact (male and female) electrically connected to the center conductor and some form of sleeve construction connected to the braid and surrounding the interconnected male and female central contacts.

SUMMARY OF THE INVENTION

In accordance with the present invention, there is provided a mated co-axial contact system including a nano-miniature pin and socket contact centered in a shielding sleeve by a dielectric insulator. The pin and socket contacts are each mechanically crimped to the respective center conductor of the co-axial wire. Prior to crimping the center conductor has solder applied to give it axial strength during mating and demating. The braid of the co-axial wire is soldered to the shielding sleeve with a disc insulator preventing electrical shorts between the center conductor and the braid of the co-axial wire. The spacing of the contacts to the shielding sleeve along with the dielectric constant of the dielectric insulator are designed so that the electrical impedance, such as 50 ohms, is matched through the co-axial contact system, thus maintaining the integrity of the electrical signal. This co-axial contact system can be used alone or it can be integrated into various electrical connectors. The termination of the co-axial contact system can include in-line co-axial wire, through-hole printed circuit board (PCB), surface mount PCB, straight mount, ninety-degree bend mount, and other custom configurations.

The foregoing and other aspects of the invention will be better understood on a reading of the specification in conjunction with the drawings, in which like reference numerals refer to like elements in the several views.

DESCRIPTION OF THE PREFERRED EMBODIMENT

Figure 2:
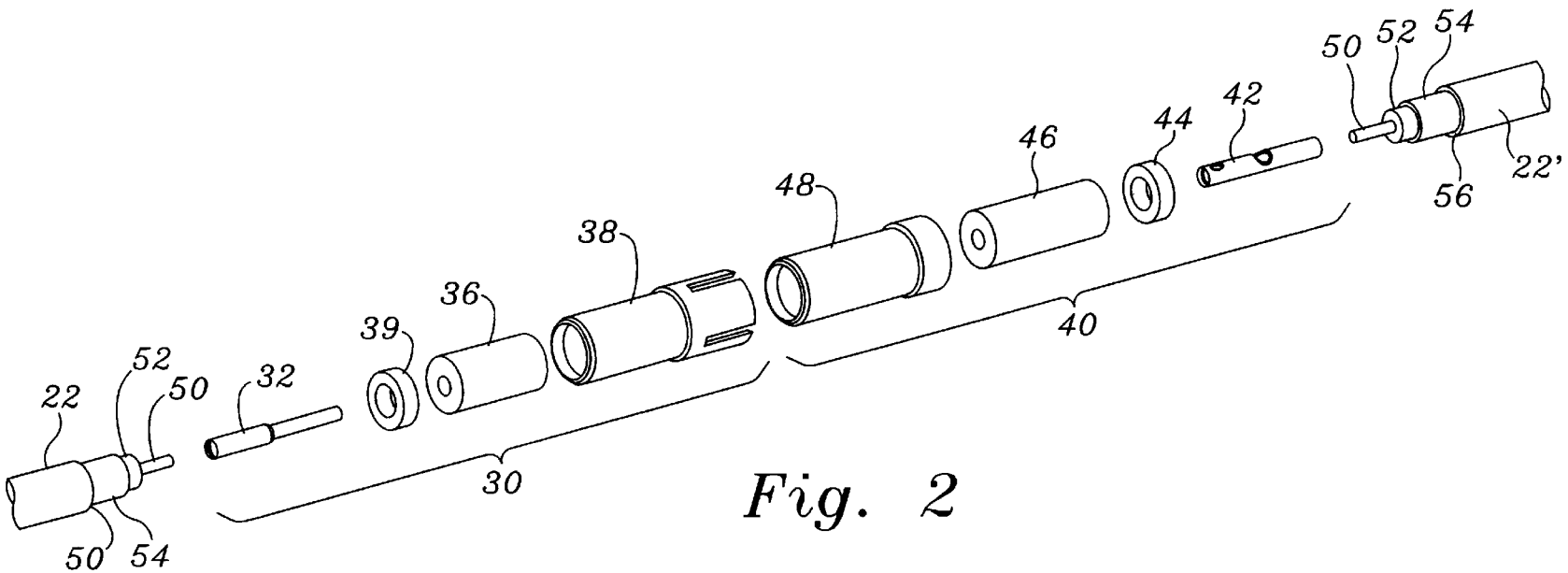
FIG. 2 is an exploded perspective view of the mated coaxial contact system as shown in FIG. 1.
Figure 1:
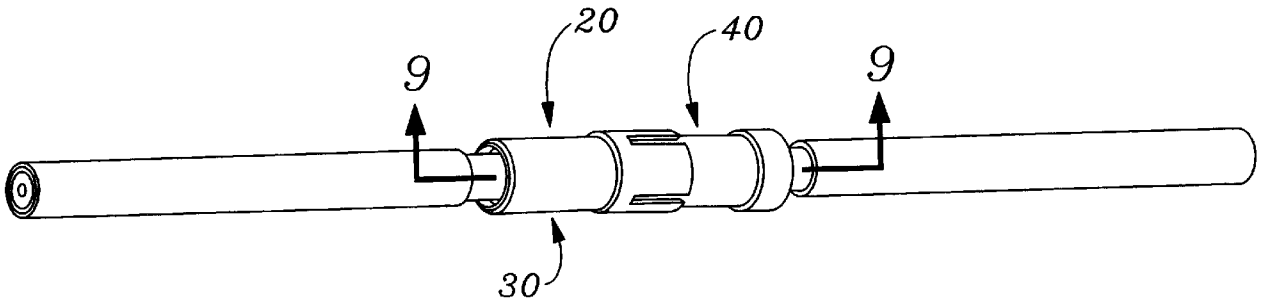
FIG. 1 is a perspective view of the mated coaxial contact system in its interconnected condition.

Referring now to the drawings and particularly to FIGS. 1 and 2, there is shown a mated coaxial contact system, generally designated 20, which includes a male portion, generally designated 30, and a female portion, generally designated 40. Each of the portions 30 and 40 is connected to a coaxial cable 22 and 22', respectively.

FIG. 2, which is an exploded view, shows the components associated with each of the portions 30 and 40. Listing the components for the male portion 30, these include the metallic, conductive pin contact 32, a dielectric washer or disc insulator member 34, a generally elongate, generally cylindrical dielectric insulator member 36, and a tubular conductive metallic shielding sleeve 38. Listing the components for the female portion 40, these include the metallic, conductive sleeve-like pin receiving contact or socket 42, a dielectric washer or disc insulator member 44, a generally elongate, generally cylindrical dielectric insulator member 46, and a conductive, metallic shielding sleeve 48.

Referring to FIGS. 1 and 2, the details of the coaxial cable 22 will be described and, for purposes of convenience, the same reference numerals will be used for the same elements in cable 22'. The coaxial cable 22 includes a center conductor 50, surrounded by an insulation layer 52, which is encased in a flexible conductive braid tube or sleeve 54, the assembly then being enclosed in an outer insulating layer 56. The central conductor 50 is ordinarily a multi-stranded or solid conductor and has the insulation 52 stripped back a predetermined length, with the flexible braid 54 being cut back another length, with the outer insulator 56 being stripped back another length.

Figure 4:
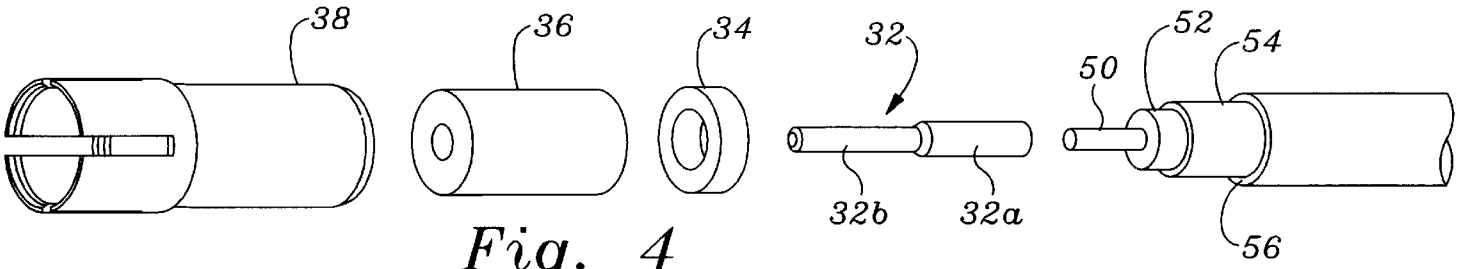
FIG. 4 is an exploded perspective view of the male portion of FIG. 3.
Figure 3:
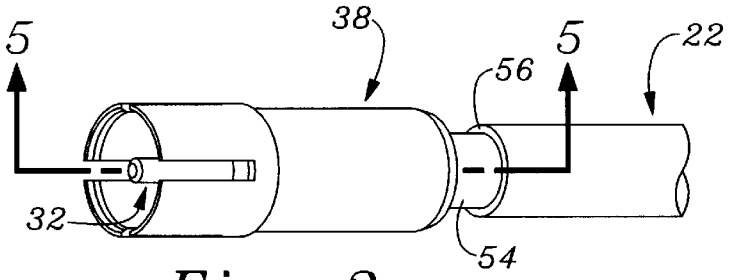
FIG. 3 is a perspective view of the male portion of the mated coaxial contact system as shown in FIG. 1.
Figure 5:
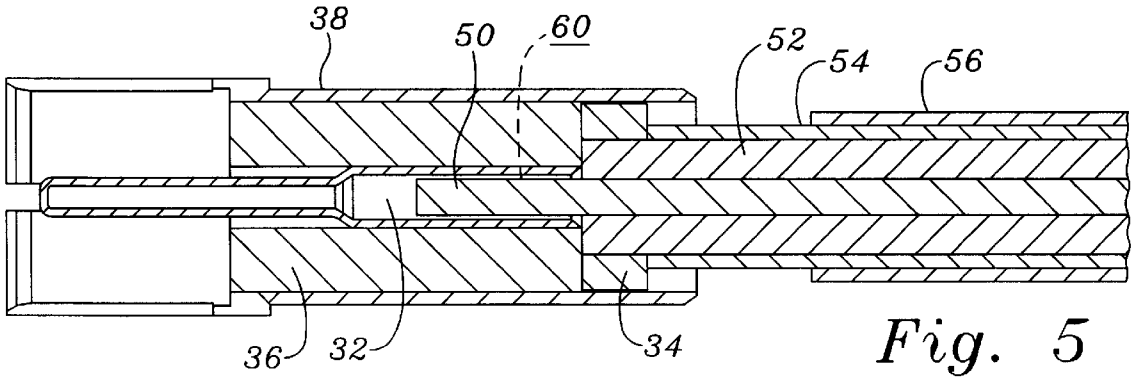
FIG. 5 is a cross-sectional view of the male portion of FIG. 3 as viewed along line 5—5 thereof.

Referring also to FIGS. 3 through 5, the particulars of the assembling of the male portion will be described. As can be seen the pin member 32 is formed as an elongate generally cup-shaped metallic member with a pin attachment part 32*a* and a pin contact part 32*b* of reduced diameter. The inner diameter of pin attachment part 32 is slightly greater than the diameter of the central conductor 50. The conductor 50, during assembly, is received in part 32 (See FIG. 5) and secured by crimping at point 60, which is at a point where the conductor 50 is within and slightly beyond the crimp point 60. Prior to crimping, solder is applied to the multi-stranded center conductor 50 to give it increased axial strength during mating and demating. At this point, the open end of pin 32 is in generally abutting relation with the adjacent insulation 52.

As shown in FIG. 5, the washer or dielectric disc member 34 has an inner diameter sufficient to pass over the inner insulation layer 52 with an outer diameter approximating the inner diameter of the shielding sleeve 38. The elongate dielectric insulating member 36 has an opening axially therethrough with an inner diameter slightly greater than the outer diameter of part 32*a* of pin contact 32. During assembly, the wire 22 is first stripped to length, then solder is applied to center conductor 50 and braid 54. Pin contact 32 is then crimped and disc insulator 36 is slid onto insulation layer 52. Dielectric insulator 36 is then pressed into tubular shielding sleeve 38, afterwhich pin contact 32, wire 22, and disc insulator 34 are pushed into dielectric insulator 36 and tubular shielding sleeve 38. Finally, braid 54 is soldered to shielding sleeve 38 to electrically connect and physically secure the sleeve 38 to the braid 54; the solder being flowed into the space over 360 degrees.

The disc insulator 34 also prevents solder from electrically shorting the center conductor and the braid of the coaxial wire. Molten solder from the shielding sleeve38 and coaxial wire braid 54 termination is physically blocked by the disc insulator 34, thus preventing electrical shorts. The other end of sleeve 38 is configured for receiving a given length of the female portion 40 as will be described hereinafter. The braid 54 of the coaxial wire 22 is thus soldered to the shielding sleeve 38 with a disc insulator 34 preventing electrical shorts between the center conductor 50 and the braid 54 of the coaxial wire 22. The spacing of the contacts to the shielding sleeve 38 along with the dielectric constant of the dielectric insulator 36 is designed so the electrical impedance, such as 50 Ohms, is matched through the coaxial contact system, thus maintaining the integrity of the electrical signal.

It is to be understood that, although the disc 34 and dielectric insulator 36 are shown as two pieces, the disc insulator and the dielectric insulator could be combined into one component provided that form, fit, and function are retained.

Figure 7:
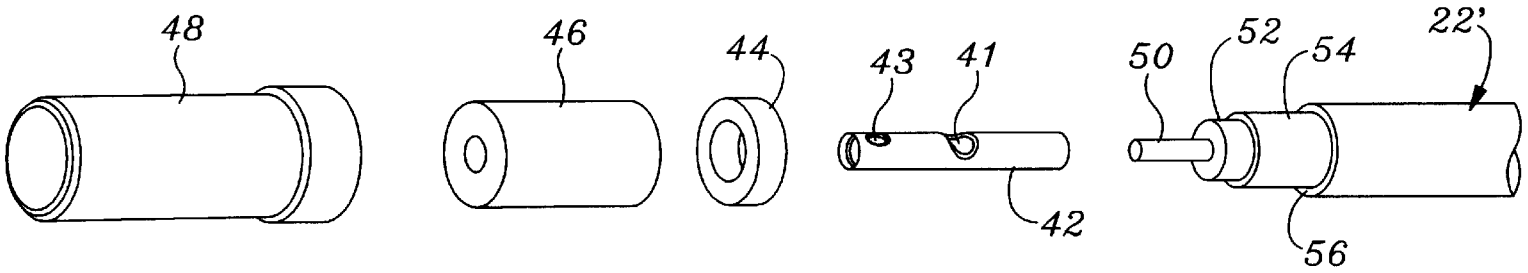
FIG. 7 is an exploded perspective view of the female portion of FIG. 6.
Figure 6:
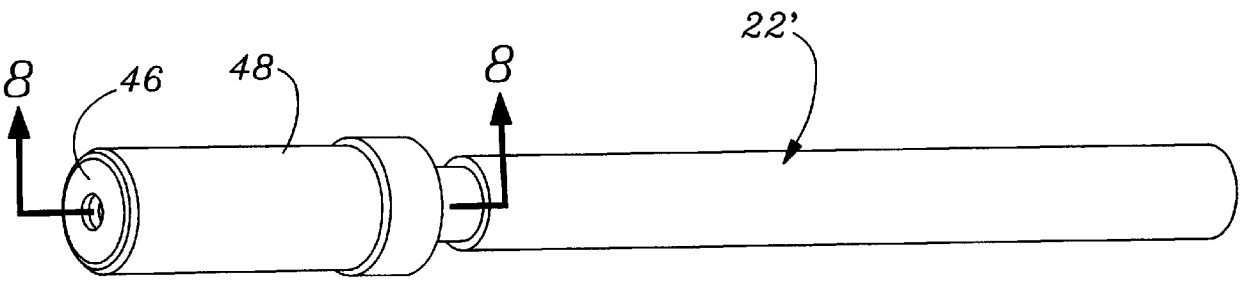
FIG. 6 is a perspective view of the female portion of the mated coaxial contact system of FIG. 1.
Figure 8:
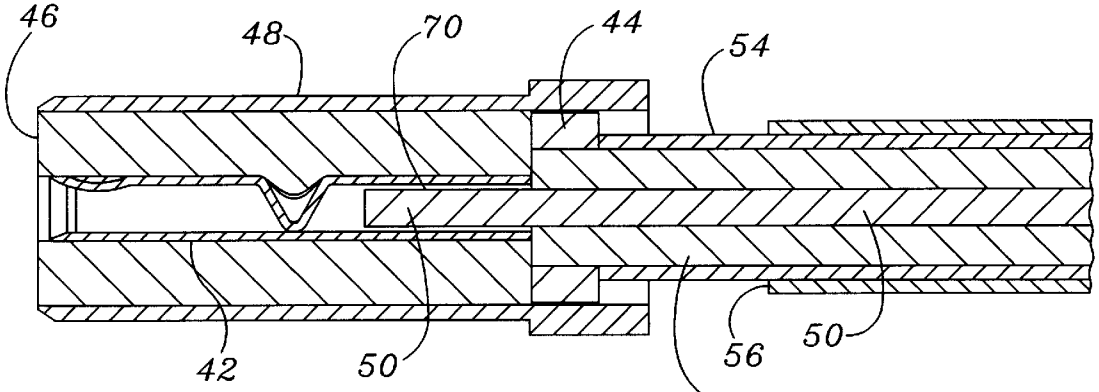
FIG. 8 is a cross-sectional view of the female portion of FIG. 6 as viewed along line 8—8 thereof.

Similarly, with respect to the female portion 40, and with reference to FIGS. 6 through 8, the particulars of the assembling of the female portion will be described. As can be seen the conductive sleeve-like pin receiving socket 42 is formed as an elongate generally tubular member with an inner diameter approximately the same as the diameter of the conductor 50, as well as the outer diameter of pin 32. The conductor 50, during assembly, is received therein (See FIG. 8) and secured by crimping at point 70 which is at a point where the conductor 50 is within and slightly beyond the crimp point 70. Prior to crimping, solder is applied to the multi-stranded center conductor to give it increased axial strength during mating and demating.

At this point, the open end of pin receiving socket 42 is in generally abutting relation with the adjacent insulation 52. As shown in FIG. 8, the washer or dielectric disc member 44 has an inner diameter sufficient to pass over the inner insulation layer 52 with an outer diameter approximating the inner diameter of the shielding sleeve 48. The elongate dielectric insulating member 46 has an opening axially therethrough with an inner diameter slightly greater than the outer diameter of part 42 of pin receiving socket 42. During assembly, essentially the same steps are used as outlined in the assembly of the male pin.

The other end of sleeve 48 is configured for insertion of a given length of the male portion 30 therein as will be described hereinafter. The braid 54 of the coaxial wire 22' is thus soldered to the shielding sleeve 48 with a disc insulator 44 preventing electrical shorts between the center conductor 50 and the braid 54 of the coaxial wire 22'. The disc insulator 44 also prevents solder from electrically shorting the center conductor and the braid of the coaxial wire during assembly. Molten solders from the shielding sleeve 48 and coaxial wire braid 54 termination is physically blocked by the disc insulator 44, thus preventing electrical shorts.

The spacing of the contacts to the shielding sleeve 48 along with the dielectric constant of the dielectric insulator 46 are designed so the electrical impedance, such as 50 Ohms, is matched throughout the coaxial contact system, thus maintaining the integrity of the electrical signal. It is to be understood that, although the disc 44 and dielectric insulator 46 are shown as two pieces, the disc insulator and the dielectric insulator could be combined into one component provided that form, fit, and function are retained. It should also be noted that the discs 34 and 44 are generally identical, as are the insulators 36 and 46.

Figure 9:
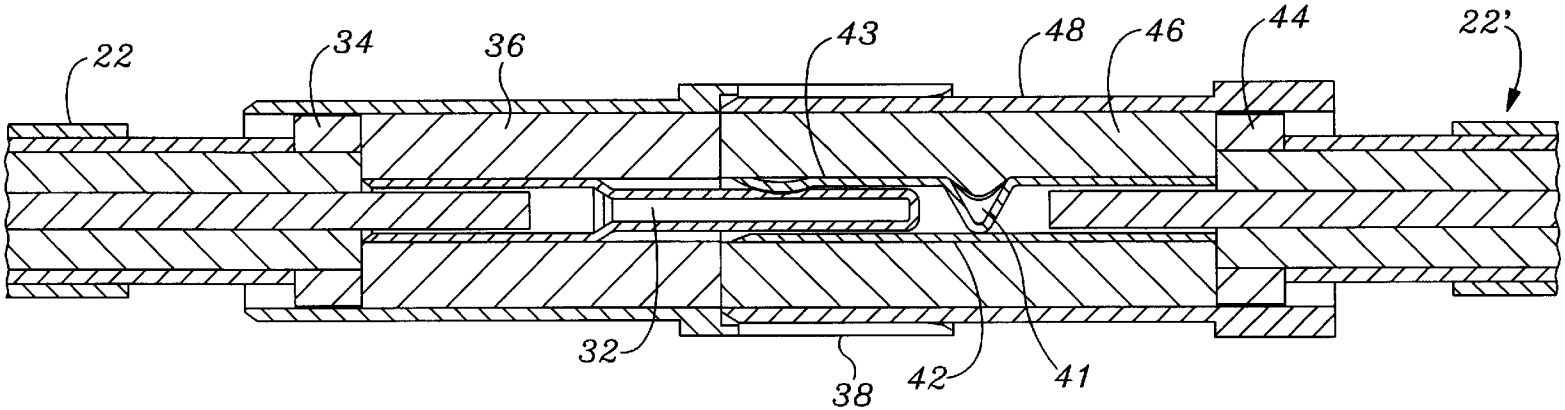
FIG. 9 is a cross-sectional view of the mated coaxial contact system of FIG. 1 as viewed along line 9—9 thereof.

FIG. 9 shows, in cross-section, the interconnection of the portions 30 and 40. The relative dimensions of the coacting parts are readily discernible from this view. It should be noted that, to provide a good frictional engagement of the pin 32 within the pin-receiving socket 42, the socket 42 is dimpled near the forward end, as at 43. Furthermore, to prevent conductor 50 from interfering with pin 32, socket 42 is deformed at the approximate midpoint 41, which is generally intermediate the conductor 50 and the pin 32. The dielectric insulator 36 (and 46) provides the correct spacing between the contacts and the shielding sleeve as well as the proper material dielectric constant. This ensures that the electrical impedance is matched from the coaxial wire through the coaxial contact system. A matched impedance system minimizes any electrical losses due to reflections or leakage. Typically, the dielectric insulator material is filly densified Teflon (PTFE). The dielectric insulator 36 (and 46) is mechanically pressed and positioned in the shielding sleeve 38 (and 48). By way of example, the shielding sleeve outside diameter is less than 0.075", thus providing a very small coaxial contact system.

In both portions, with the shielding sleeve soldered to the braid of the coaxial wire, continuous electrical shielding is provided, as well as a means of mechanically locking the coaxial wire to the shielding sleeve/dielectric insulator assembly. The center conductor of the coaxial wire usually carries a low-level signal that is very susceptible to stray interference. A continuous electrical shield protects the low-level signal on the center conductor by blocking the stray interference. The fully mated shielding sleeves along with 360° solder fillets achieve a continuous electrical shield between the braid of the coaxial wire and the shielding sleeve.

Note that shielding sleeves are fully mated when the male shielding sleeve approaches bottoming against the step in the female shielding sleeve. This approximate bottoming leaves a small gap, however, the tangs of the female shielding sleeve abut the outside diameter of the male shielding sleeve to provide electrical continuity. The solder also mechanically retains the coaxial wire within the shielding sleeve/dielectric insulator assembly. The contact is also retained within the shielding sleeve/dielectric insulator assembly since it is crimped to the center conductor of the coaxial wire.

With the pin and socket contacts mechanically crimped to the center conductor of the coaxial wire, since there is no solder to reflow, thus the continuity from the center conductor through the contacts is guaranteed after solder termination of the braid. Solder is applied to conductor 50 for increased axial strength, however, there is no reflow of this solder.

Of significance to the system is the disc insulator, which is positioned over a small exposed section of the coaxial wire dielectric. When inserted fully into the shielding sleeve/dielectric insulator assembly, the coaxial wire dielectric and disc insulator are flush with the back of the dielectric insulator. This positions the contacts with regards to the front of the shielding sleeve, since the backs of the crimped contacts are flush with the coaxial wire dielectric. This positioning provides proper pin contact to socket contact mating. The disc insulator also prevents solder from electrically shorting the center conductor and the braid of the coaxial wire.

As previously discussed, during assembly of each portion 30 and 40, molten solder from the shielding sleeve/coaxial wire braid termination is physically blocked by the disc insulator, thus preventing electrical shorts. The coaxial contact system hereinabove described can adapt to various sizes of coaxial wire. This assumes that the center conductor can be crimped in the standard nano-miniature contacts and that the shield outside diameter is smaller than the shielding sleeve inside diameter. Also, the inside diameter of the disc insulator may change to fit over the dielectric of the coaxial wire.

Various electrical connector, such a rectangular and circular, can house the coaxial contact system. The shielding sleeve dielectric insulator assembly would be pressed into the connector insulator prior to solder termination of the coaxial wire braid. After termination, the back end of the coaxial contact system would be potted with epoxy to further lock in place and to provide strain relief. The coaxial contact system can also be used alone as an in-line coaxial connection. Heat shrink can be added over the mated coaxial contact system for mechanical retention. The back end of the coaxial contact system can be modified for different terminations such as through hole printed circuit board (PCB), surface mount PCB, straight mount, 90 degree bend, and other custom configurations.

In accordance with the present invention there has been shown and described a preferred embodiment of a coaxial system comprised of a nano-miniature socket contact centered in a shielding sleeve by a dielectric insulator. The pin and socket contacts are crimped to the center conductor of the coaxial wire. The braid of the coaxial wire is soldered to the shielding sleeve with a disc insulator preventing electrical shorts between the center conductor and the braid of the coaxial wire. The spacing of the contacts to the shielding sleeve along with the dielectric constant of the dielectric insulator are designed to the electrical impedance, such as 50 ohms, is matched through the coaxial contact system, thus maintaining the integrity of the electrical signal. This coaxial contact system can be used alone or it can be integrated into various electrical connectors. The termination of the coaxial contact system can include in-line coaxial wire, through hole printed circuit board (PCB), surface mount PCB, straight mount, 90-degree bend mount, and other custom configurations. While there has been shown and described a preferred embodiment, it is to be understood that various other adaptations and modifications may be made within the spirit and scope of the invention.

What is claimed is:

1. A contact arrangement for use with coaxial cable having a central conductor covered by a first inner insulation layer with a tubular metallic braid in turn covering said first insulating layer and an outer insulating layer covering said braid, said contact arrangement comprising:

a pin type contact means secured to an exposed end of said central conductor;

a tubular shielding sleeve; and dielectric means within said sleeve having a portion thereof encircling an exposed end section of said first insulation layer for providing radial displacement between said tubular metallic braid and said central conductor for enabling soldering of said tubular shielding sleeve to said braid, and for preventing solder from electrically shorting said central conductor and said braid of said coaxial cable.

2. The contact arrangement of claim 1 wherein said pin type contact means is one of a male pin and a female socket.

3. The contact arrangement of claim 2 wherein said female socket comprises:

a conductive socket member having a first end for connection to the central conductor of a second cable and a second end for receiving said pin contact means;

a shielding sleeve encircling and electrically connected to an exposed portion of the braid of said second cable;

dielectric means within said sleeve of said second cable having a portion thereof encircling an exposed end section of the insulating layer of said second cable to provide radial displacement between the braid and central conductor of said second cable for enabling soldering of the shielding sleeve to the braid of said second cable, and for preventing solder from electrically shorting said central conductor and braid of said second cable; and wherein the mating of said pin contact member and said socket member provides a continuous electrical shield with matched electrical impedance between said first and said second cables.

4. A method of assembling a contact for a coaxial cable having a central conductor covered by a first inner insulation layer with a tubular metallic braid in turn covering said first insulating layer and an outer insulating layer covering said braid, said method comprising:

stripping said cable to expose a given length of said central conductor;

stripping said braid a predetermined distance back from the exposed portion of said central conductor to expose a portion of said first insulation layer;

stripping said outer insulation layer a given distance back from the exposed portion of said braid;

providing a contact member with an inner tubular portion for positioning over the exposed given length of said central conductor;

providing a conductive shielding sleeve;

placing dielectric means within said shielding sleeve to provide radial displacement between said braid and said central conductor with said dielectric means extending said predetermined distance over said first insulation layer;

soldering said braid to said shielding sleeve in said given distance of said exposed braid to provide for continuous electrical shielding and whereby said dielectric means overlying said first insulation layer prevents solder from electrically shorting said central conductor and said braid.

5. A coaxial cable connector assembly for connecting a first cable to a second cable, each cable having a central conductor covered by a inner insulation layer with a tubular metallic braid in turn covering said inner insulating layer and an outer insulating layer covering said braid, said assembly comprising:

a male portion including a pin member having a pin contact part and a pin attachment part for conductively receiving a stripped back portion of the central conductor of said first cable, a first dielectric member encircling a further stripped back portion of the inner insulation layer of said first cable and extending over said pin attachment part and a portion of said pin contact part, and a first conductive shielding sleeve encircling a still further stripped back portion of the braid of said first cable and extending over said first dielectric member and said pin contact part, said first shielding sleeve electrically connected to said braid;

a female portion including a first end for conductively receiving a stripped back part of the central conductor of said second cable and a second end for conductively receiving said pin contact part, a second dielectric member encircling a further stripped back portion of the inner insulation layer of said second cable and extending over said female portion, and a second conductive shielding sleeve extending over said second dielectric member and encircling a still further stripped back portion of the braid of said second cable, said second sleeve electrically connected to said braid of said second cable; and wherein the mating of said male and female portions provide a continuous electrical shield with matched electrical impedance between said first and said second cables.

6. The coaxial cable connector assembly of claim 5 wherein said first and second dielectric members are generally identical.

7. The coaxial cable connector assembly of claim 5 wherein said second shielding sleeve is configured for receiving said first shielding sleeve in good frictional engagement.

8. The coaxial cable connector assembly of claim 5 wherein said first and said second dielectric members have a portion thereof encircling an exposed end section of their respective insulation layer for providing radial displacement between their respective braid and central conductors for enabling soldering of their respective shielding sleeve to their braid, and for preventing solder from electrically shorting their respective central conductors and braid.

9. A coaxial contact system having one or more connector assemblies for connecting a first cable to a second cable, each cable having at least a central conductor and an outer conductor separated by an inner insulating layer, said assembly comprising:

a pin contact member for conductive connection to the central conductor of said first cable;

a first dielectric member encircling an exposed portion of the inner insulation layer of said first cable and extending over a first portion of said pin contact member;

a first shielding sleeve encircling an exposed portion of the outer conductor of said first cable and extending over the remainder portion of said pin contact member, said first shielding sleeve electrically connected to said outer conductor of said first cable;

a conductive socket member having a first end for connection to the central conductor of said second cable and a second end for receiving said remainder portion of said pin contact member;

a second dielectric member encircling an exposed portion of the inner insulation layer of said second cable and extending over said socket member; and a second shielding sleeve encircling and electrically connected to an exposed portion of the outer conductor of said second cable; and wherein the mating of said pin contact member and said socket member provides a continuous electrical shield with matched electrical impedance between said first and said second cables.

10. The coaxial cable connector assembly of claim 9 wherein said first and second dielectric members are generally identical.

11. The coaxial cable connector assembly of claim 9 wherein said second shielding sleeve is configured for receiving said first shielding sleeve in good frictional engagement.

12. The coaxial cable connector assembly of claim 9 wherein said first and said second dielectric members have a portion thereof encircling an exposed end section of their respective insulation layer for providing radial displacement between their respective outer conductors for enabling soldering of their respective shielding sleeve to their outer conductor and for preventing solder from electrically shorting their respective central conductors and outer conductors.

* * * * *